US007639928B2

(12) United States Patent
Coke

(10) Patent No.: US 7,639,928 B2
(45) Date of Patent: Dec. 29, 2009

(54) 360° PORTABLE ELECTRIC SPACE HEATER

(76) Inventor: Carl Garfield Coke, 481 Rutland Rd., Bklyn, NY (US) 11203

( * ) Notice: Subject to any disclaimer, the term of this patent is extended or adjusted under 35 U.S.C. 154(b) by 274 days.

(21) Appl. No.: 11/731,190

(22) Filed: Mar. 30, 2007

(65) Prior Publication Data

US 2008/0240689 A1 Oct. 2, 2008

(51) Int. Cl.
*F24D 15/02* (2006.01)

(52) U.S. Cl. ..... 392/367; 392/347; 392/356

(58) Field of Classification Search ..... 392/354, 392/355, 356, 357, 358
See application file for complete search history.

(56) References Cited

U.S. PATENT DOCUMENTS

| | | | | | |
|---|---|---|---|---|---|
| 896,554 | A * | 8/1908 | Kyle | 392/367 |
| 1,798,290 | A * | 3/1931 | Winner et al. | 392/367 |
| 1,863,882 | A * | 6/1932 | Scharf | 165/121 |
| 1,979,883 | A * | 11/1934 | Hynes | 392/356 |
| 2,379,705 | A * | 7/1945 | Graves | 392/356 |
| 2,389,839 | A * | 11/1945 | Brown | 392/356 |
| 2,491,849 | A * | 12/1949 | Broome | 392/358 |
| 4,053,732 | A * | 10/1977 | Carter | 392/358 |
| 4,234,782 | A * | 11/1980 | Barabas et al. | 392/345 |
| 5,245,692 | A * | 9/1993 | Kawai | 392/367 |
| 5,437,001 | A | 7/1995 | Chaney et al. | |
| 5,619,612 | A * | 4/1997 | Glucksman et al. | 392/360 |
| 5,655,055 | A * | 8/1997 | Goldstein et al. | 392/367 |
| 5,665,258 | A | 9/1997 | Hsu | |
| 6,351,602 | B1 | 2/2002 | Chaney et al. | |
| 6,644,300 | B1 | 11/2003 | Toribio | |
| 6,971,380 | B2 | 12/2005 | Mills et al. | |
| 7,500,760 | B2 * | 3/2009 | Byrne | 362/92 |
| 2002/0081107 | A1 * | 6/2002 | Reiker | 392/364 |
| 2005/0196719 | A1 | 9/2005 | Mills et al. | |

* cited by examiner

*Primary Examiner*—Thor S Campbell
(74) *Attorney, Agent, or Firm*—Allan Chan; Allan Chan & Associates

(57) ABSTRACT

A portable air heating system for use in all areas is disclosed. The portable air heating system provides a stream heated air for use in heating the interior of a structure, in 360°, multidirection, or a direction. Directional heating is accomplished through exhausts ports located all around the assembly. The heating system generally comprises an air transfer assembly for providing a flow of air through the system, an electrical heat emitting assembly, and a heat transfer housing for safely transferring the heat produced by the electrical heating assembly to the air flowing through the transfer assembly. Additionally, liquid filled bladders may be added to the heat emitting assembly to conserve and retain heat longer which will be said unit more energy efficient. The present heating system is also highly portable and simple to use, thereby providing an efficient mechanism for providing perform conditioning functions, such as air moving, heating, or cooling.

13 Claims, 4 Drawing Sheets

360° PORTABLE ELECTRIC SPACE HEATER

FIELD OF THE INVENTION

This invention relates to portable electric space heaters with a 360°, multidirectional or directional heated air out flow.

BACKGROUND OF THE INVENTION

Portable electric space heaters have long been used to provide heat, whether radiant, conductive and/or convective, to a local area. Electric space heaters commonly used in the home or office typically emit heat in a single, fixed direction, although some units are provided with an oscillating feature so that heat may be provided across an angular range of motion of the heater. The current invention supplies heat continuously in 360° around the unit efficiently disturbing heat. Alternatively, said current invention may out put the heated air in a multidirectional flows whereas each flow maybe 45 degrees from each other focused on the particular position(s) of person(s) arrange by said invention.

BRIEF SUMMARY OF THE INVENTION

A portable air heating system for use in all areas is disclosed. The portable air heating system provides a stream heated air for use in heating the interior of a structure, in a 360°, multidirectional, or directional output. Directional heating is accomplished through exhausts ports located all around the assembly. The heating system generally comprises an air transfer assembly for providing a flow of air through the system, an electrical heat emitting assembly, and a heat transfer housing for safely transferring the heat produced by the electrical heating assembly to the air flowing through the transfer assembly. Additionally, liquid filled bladders may be added to the heat emitting assembly to conserve and retain heat longer. The present heating system is also highly portable and simple to use, thereby providing an efficient mechanism for providing perform conditioning functions, such as air moving, heating, or cooling.

DETAILED DESCRIPTION

As discussed above, illustrative embodiments in accordance with the invention provide a portable heater being able to throw heat in a 360°, multidirectional, or directional. The heating units may produce heat in any suitable way, such as radiant, convective and/or conductive heating. In one illustrative embodiment, the heating units include an electrically-powered heating element that heats air passed through the element. At least one fan 6 may also be incorporated in each heating unit to move air past the heating element(s) 7.

In one aspect of the invention, the separable heating units may be supplied with electric power by a common electrical connection or power source. For example, the heater may have a single plug and wire connector that may be connected to a common household outlet. Electrical power from the plug and wire connector may be supplied to all of the heating units in the heater through electrical connections between the units. As known to persons skilled in the art said heater may be connected to temperature controls. Said controls may be programmable based on temperature and/or time. Additionally, a remote control device may be utilized to control the functionality of the device remotely.

Figure 1:
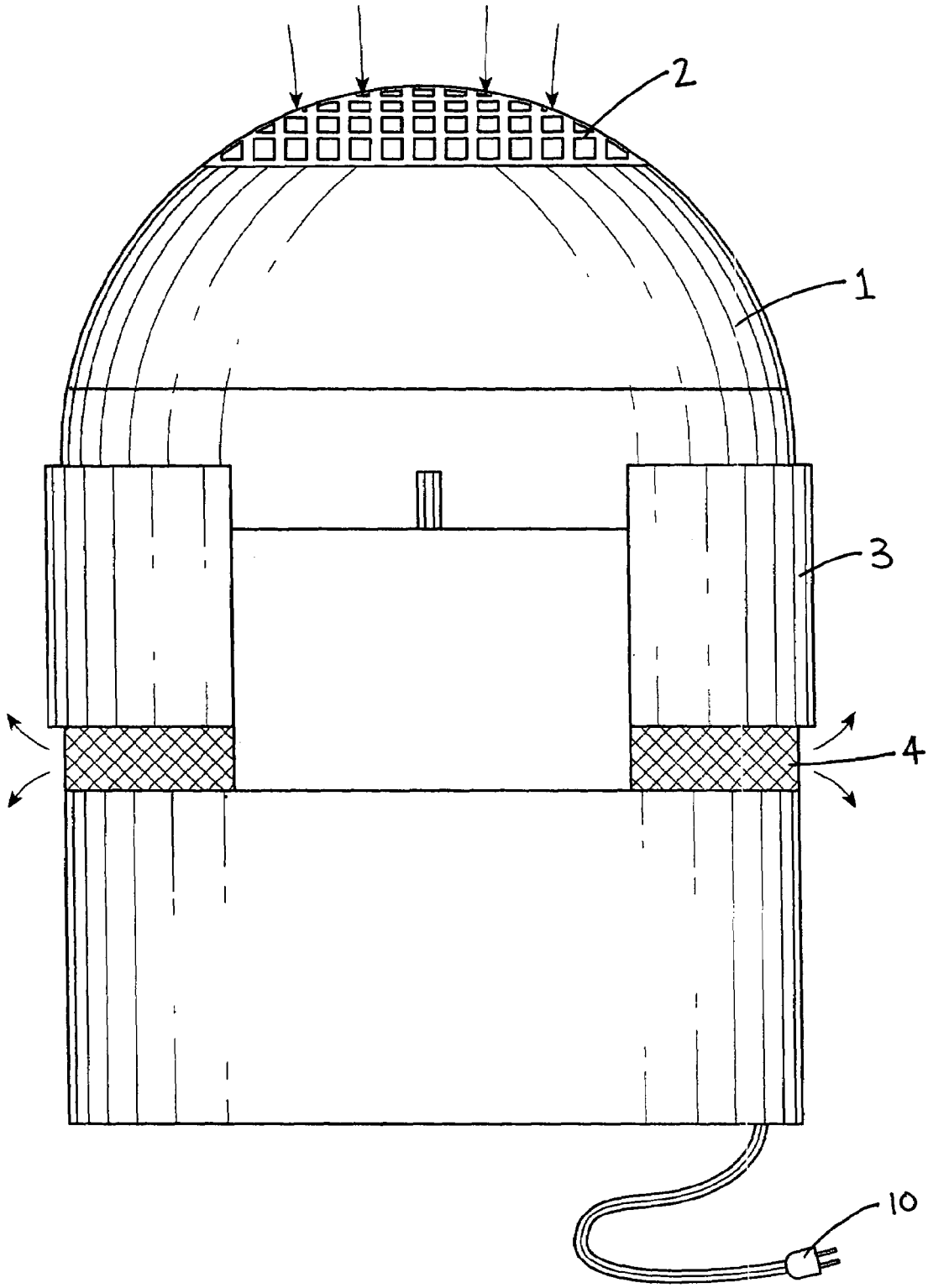
FIG. 1 is a perspective view of one embodiment a portable air heating exterior.
Figure 2:
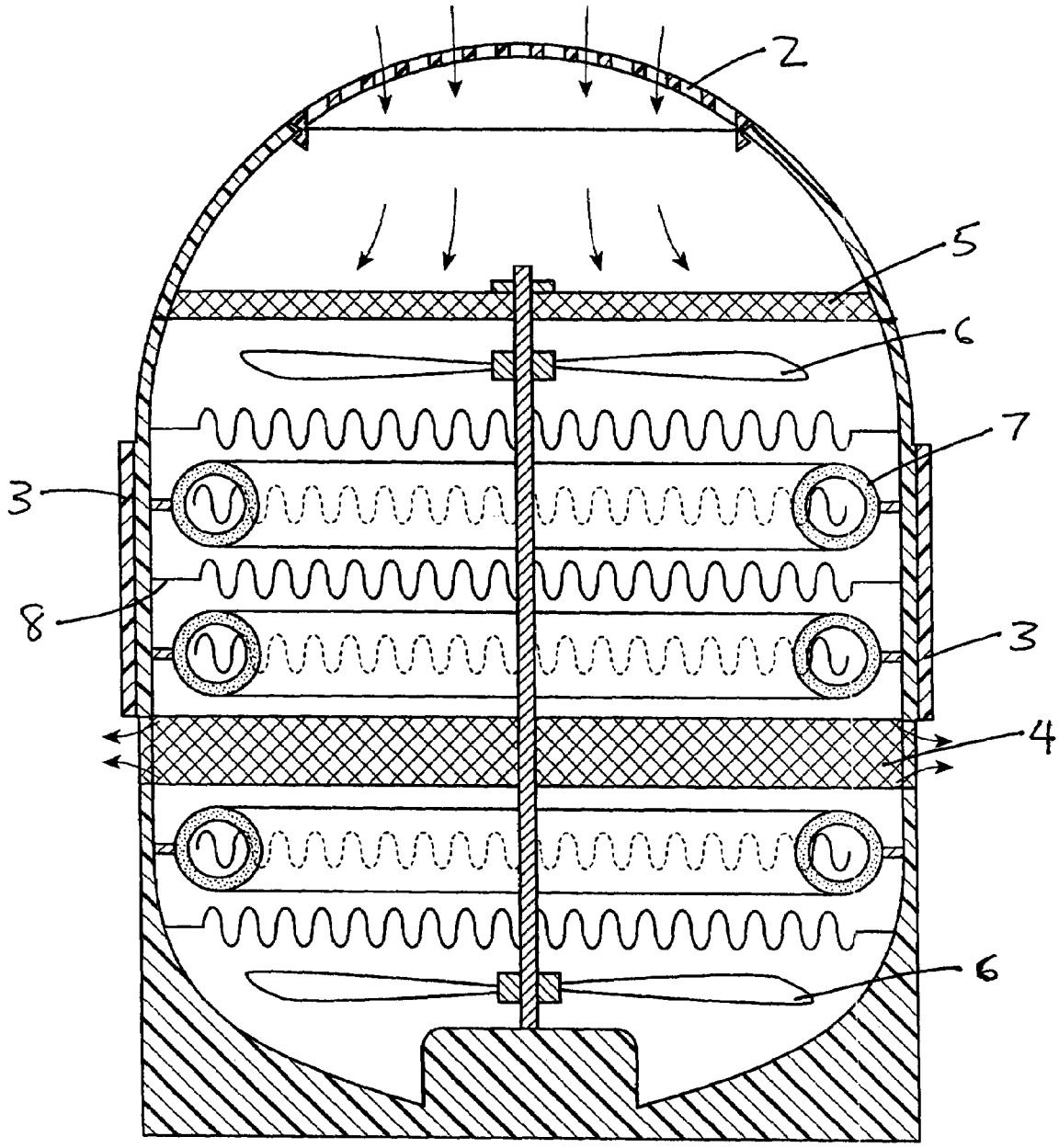
FIG. 2 is a perspective-view of the portable air heating system shown in FIG. 1 in further detail.
Figure 3:
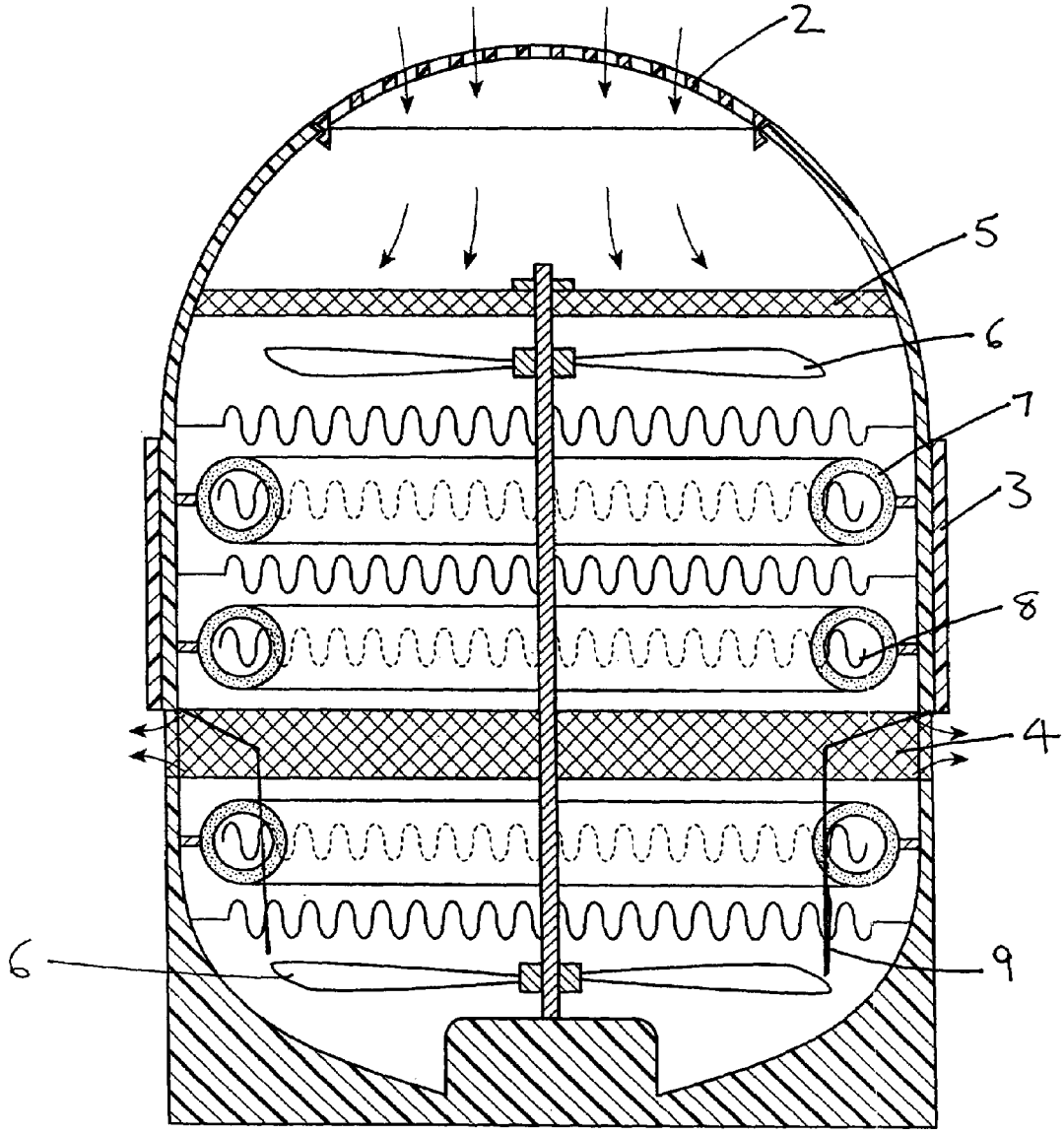
FIG. 3 is a perspective-view of one embodiment of an air outlet conduit of the portable air heating system shown in FIG. 2 in an expanded position.
Figure 4:
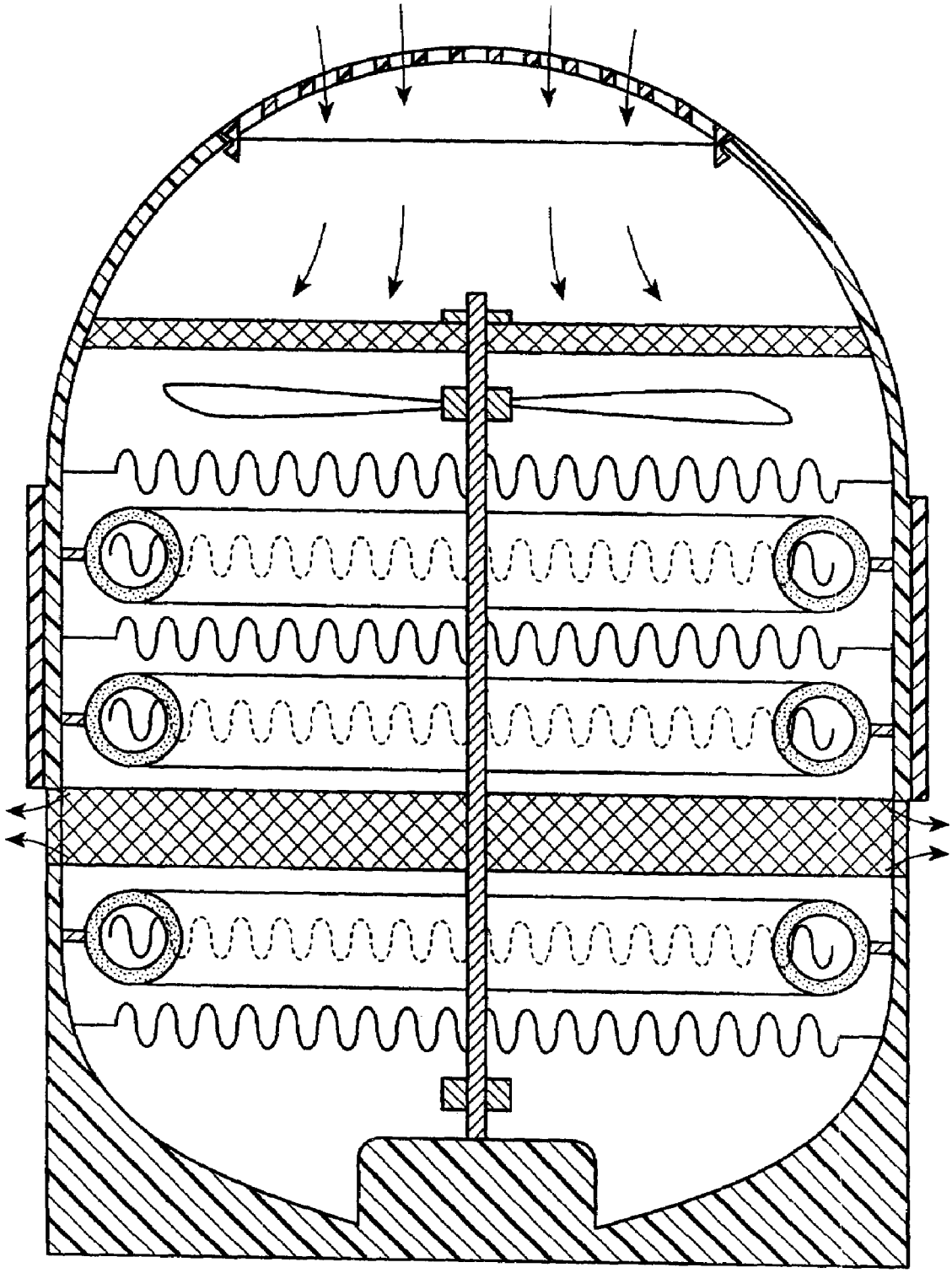
FIG. 4 is a perspective-view of one embodiment of the portable air heating system with one fan.

FIG. 1 shows an illustrative embodiment of a heating apparatus 1 that incorporates various aspects of the invention. The heating unit includes at least one air inlet 2 and at least one air outlet(s) 4 arranged so that air may move through vertical interior of the unit from the air inlet 2 to the air outlet(s) 4. In the preferred embodiment, the air is pulled into the heating apparatus through the air inlet 2 with the use of fan(s) 6 and deflected out at the interior curved base of the unit. Alternatively, air conduit(s) 9 may be used to direct heated air exhaust out the air outlets. In this illustrative embodiment, the air inlet 2 and air outlet(s) 4 are positioned on top and sides of the heating unit, but any suitable arrangement of the air inlet 2 and outlet 4 may be used. For example, the air outlet(s) 4 may be positioned at various heights from the base.

In this illustrative embodiment, the heating unit 1, include at least one heating element 8 that heats air as it moves from the air inlet 2 to the air outlet(s) 4. Any suitable type or arrangement of heating elements may be used, such as electrical resistance heaters, radiant heating devices, and so on. The heating unit may also include at least one fan 6 that causes air to move from the air inlet two past the heating element(s) 8 to the air outlet 4. In one embodiment, two fans 6 are utilized one fan in close proximity to the air inlet 2 to facilitate the intake of air from the surroundings, and another fan 6 in close proximity to the base the facilitate the deflection of air out of the unit. Additionally, in an embodiment utilizing two fans 6, the fan 6 located in the closest proximity of the air inlet two shall rotate in a higher velocity than the fan 6 for throwing the air out of the unit through the air outlet 4. Alternatively, in an embodiment, the intake fan 6 may be larger in size than the outlet fan 6.

Thus, each of the heating unit is constructed and arranged to heat air and output the heated air through the air outlet(s) 4. Additionally, in the preferred embodiment, the heating unit may also incorporate at least one bladder 7 which contain heat retaining liquids such as but not limited to oil. Such bladders may provide more consistent and prolonged heating which ultimately be more energy efficient.

Although in this illustrative embodiment the heating unit are arranged to heat air, the heating unit may output heat in any suitable way, such as by convective, radiant and/or conductive means. Moreover, the unit may be arranged to perform any suitable air conditioning function, including heating, moving (e.g., function as an air fan), filtering or any suitable combination of air conditioning functions. Thus, as used herein, the term "air conditioning" is not used to refer only to air cooling, but also any of the other functions mentioned above.

In this illustrative embodiment, the heating unit may have electrical connector 10, which may be a plug and wire connector adapted to interface with a standard electrical wall outlet. The heating unit may have a power supply, such as a battery, solar or fuel cell, or other power source that may be located within the housing of the heating units. The heating unit may also include controls to control the operation of heating unit. The controls may include rotatable knobs, depressable buttons, voice or sound actuated switches, remote control system or any other suitable device to control the operation of the unit. Thus, a user may turn the unit on, adjust a temperature setting or air flow rate, or other operational features using said of controls. The unit may also include safety devices, such as temperature sensors, used to shut the heating element(s) off in high temperature conditions, e.g., when an air inlet 2 or air outlet 4 is obstructed, or in the event of a short circuit.

One aspect of the invention incorporated in the FIG. 1 embodiment is that the heating unit may be throwing heated air in 360°, multidirectional, or directional. In one embodiment, at least one panel(s) 3 may be opened on the sides of the unit to allow heated air to exit the air outlet(s) 4 directed to each output heat toward persons located in separate areas of a room. Said panel(s) may be opened vertically or horizontally on a track. Additionally said panel(s) 3 may be telescopic in nature. In an alternative embodiment, vents which may be opened and closed can be located on the sides of the unit. In the preferred embodiment, four panels are used on the sides of the unit covering 360° of the exterior surface. For example, two adjacent panels 3 may be opened to throw two streams of air directed 90° from each other. Another example is all the panels 3 may be opened to throw heated air evenly in 360° around the unit. Additionally, two panels may be opened 180° from each other accomplish the warming of people sitting across from each other. Such an arrangement may have advantages over utilizing more than one heating unit by being more space efficient and energy efficient.

Such an arrangement may have advantages over oscillating heaters since an approximately constant output of heat may be directed toward a particular area, unlike oscillating heaters which change the direction in which heat is thrown. This is not to say, however, that each unit 11 and 12 may not have an oscillating feature. To the contrary, one or both of the units 11 and 12 may have an oscillating feature or otherwise change a direction in which heat is produced. Another potential advantage of this aspect of the invention is that a single heating apparatus may either be joined to heat one particular area, or separated into two or more heating units to heat two or more separate areas. Thus, it should be understood that although the FIG. 1 embodiment includes two heating units 11 and 12, the heating apparatus 10 may include three or more separable heating units.

Lastly in the preferred embodiment, a HEPA filter 5 is removably mounted within the heating unit near the air inlet 2 by removing the top portion of the heating unit. Additionally, any other type of filter may be utilized to further condition the air as the user desires. The filter not only purifies the air for the user, but is also utilized to keep the air flow within the heating unit free from blockages to facilitate air passage within the unit.

While the above invention has been described with reference to certain preferred embodiments, the scope of the present invention is not limited to these embodiments. One skilled in the art may find variations of these preferred embodiments which, nevertheless, fall within the spirit of the present invention, whose scope is defined by the claims set forth below.

I claim:

1. A portable 360° heating device comprising:

a. A housing aerated long sides and top enclosing at least one heating element, motor, motor shaft, at least one heat retainer, filter, controls, and at least one fan blade;

b. A motor located in the central base of the housing;

c. A motor shaft extending from the motor to at least one fan blade d. At least one fan blade pulling air into said housing and expelling air out of the housing in 360°;

e. At least one heating element to the air current;

f. At least one heat retainer attached to the inner walls of the housing;

g. At least one control electrically attached to the motor and heating element; and h. At least one vertically sliding panel may be opened directed to output heat toward persons located in separate areas of a room for multidirectional heating.

2. A portable 360° heating device comprising:

a. A housing enclosing at least one heating element, motor, motor shall, at least one heat retainer, filter, controls, timer, temperature sensor, and at least one fan blade;

b. A motor located in the central base of the housing;

c. A motor shaft extending from the motor to at least one fan blade;

d. At least one fan blade pulling air into said housing and expelling air out of the housing in 360°;

e. At least one heating element to the air current;

f. At least one heat retainer attached to the inner walls of the housing;

g. At least one control electrically attached to the motor, timer, temperature sensor and heating element; and h. At least one vertically sliding panel may be opened directed to output heat toward persons located in separate areas of a room for multidirectional heating.

3. A portable 360° heating device comprising:

a. A housing enclosing at least one heating element, motor, motor shaft, at least one heat retainer, filter, controls, timer, temperature sensor, and at least one fan blade;

b. A motor located in the central base of the housing;

c. A motor shaft extending from the motor to at least one fan blade;

d. At least one fan blade pulling air into said housing and expelling air out of the housing in 360°;

e. At least one replaceable filter located near a air intake of said housing;

f. At least one heating element to the air current;

g. At least one heat retainer attached to the inner walls of the housing to ensure even heating and prolonged warmth;

h. At least one control electrically attached to the motor, timer, temperature sensor and heating element; and i. At least one vertically sliding panel may be opened directed to output heat toward persons located in separate areas of a room for multidirectional heating.

4. An apparatus as in claim 3 whereas the heating element is a heating coil.

5. An apparatus as in claim 3 whereas the heating element is ceramic.

6. An apparatus as in claim 3 whereas the heat retainer is ceramic.

7. An apparatus as in claim 3 whereas the heat retainer is filled with a liquid which retains heat for longer periods.

8. An apparatus as in claim 3 whereas the base is curved to allow air taken into the apparatus to be deflected out in 360°.

9. An apparatus as in claim 3 whereas the controls additionally allow for remote activation with a wireless controller.

10. An apparatus as in claim 3 whereas the filter is a HEPA filter.

11. An apparatus as in claim 3 whereas at least one panel may be opened to direct air flow expelled from the unit.

12. An apparatus as in claim 3 whereas at least one vent may be opened to direct air flow expelled from the unit.

13. A portable 360° heating device comprising:

a. A housing enclosing at least one heating element, motor, motor shaft, at least one heal retainer, filter, controls, timer, temperature sensor, and at least one fan blade;

b. A motor located in the central base of the housing;

c. A motor shaft extending from the motor to at least one fan blade;

d. At least one fan blade pulling air into said housing and expelling air out of the housing in 360°;

e. At least one replaceable filter located near a air intake of said housing;

f. At least one heating element to the air current integrated within the heat retainer;

g. At least one heat retainer attached to the inner walls of the housing to ensure even heating and prolonged warmth;

h. At least one control electrically attached to the motor, timer, temperature sensor and heating element; slid i. At least one vertically sliding panel may be opened directed to output heat toward persons located in separate areas of a room for multidirectional heating.

* * * * *